US012492499B2

(12) United States Patent
Liu

(10) Patent No.: US 12,492,499 B2
(45) Date of Patent: Dec. 9, 2025

(54) LAUNDRY TREATMENT DEVICE, WATER TEMPERATURE CONTROL METHOD AND APPARATUS THEREFOR, AND STORAGE MEDIUM

(71) Applicant: WUXI FILIN ELECTRONICS CO., LTD., Wuxi (CN)

(72) Inventor: Zonggui Liu, Wuxi (CN)

(73) Assignee: WUXI FILIN ELECTRONICS CO., LTD., Wuxi (CN)

( * ) Notice: Subject to any disclaimer, the term of this patent is extended or adjusted under 35 U.S.C. 154(b) by 253 days.

(21) Appl. No.: 18/024,964

(22) PCT Filed: Apr. 12, 2021

(86) PCT No.: PCT/CN2021/086658
§ 371 (c)(1),
(2) Date: Mar. 6, 2023

(87) PCT Pub. No.: WO2022/052460
PCT Pub. Date: Mar. 17, 2022

(65) Prior Publication Data

US 2023/0323582 A1 Oct. 12, 2023

(30) Foreign Application Priority Data

Sep. 8, 2020 (CN) ..... 202010936519.6

(51) Int. Cl.
*D06F 33/47* (2020.01)
*D06F 33/34* (2020.01)
(Continued)

(52) U.S. Cl.
CPC ..... *D06F 33/47* (2020.02); *D06F 33/34* (2020.02); *D06F 34/24* (2020.02); *D06F 33/36* (2020.02);
(Continued)

(58) Field of Classification Search
CPC ..... D06F 33/34; D06F 33/32; D06F 34/24
See application file for complete search history.

(56) References Cited

U.S. PATENT DOCUMENTS 6,634,048 B1 * 10/2003 Hornung ..... D06F 33/34 68/12.03
2006/0191078 A1 * 8/2006 Kim ..... D06F 33/32 8/158
2012/0193985 A1 8/2012 Kim et al.

FOREIGN PATENT DOCUMENTS

CN 1203980 A 1/1999
CN 1824877 A 8/2006
(Continued)

OTHER PUBLICATIONS

Machine translation of WO2019154297A1, dated Aug. 15, 2019. (Year: 2019).*
(Continued)

*Primary Examiner* — Michael E Barr
*Assistant Examiner* — Kevin G Lee
(74) *Attorney, Agent, or Firm* — K&L Gates LLP

(57) ABSTRACT

Provided are a laundry treating device and a water temperature control method and apparatus therefor. The laundry treating device includes a cold water inlet and a hot water inlet, and the control method includes: detecting a water temperature in the laundry treating device in response to determining that warm water is to be introduced into the laundry treating device, and controlling the laundry treating device based on the water temperature to enable inflowing of cold water through the cold water inlet and inflowing of hot water through the hot water inlet alternately; detecting a water level in the laundry treating device, and controlling the laundry treating device to stop water inflow in response to determining that the water level in the laundry treating device reaches a first predetermined water level; and con-
(Continued)

trolling the laundry treating device to perform washing for a first predetermined duration based on a predetermined washing cycle.

17 Claims, 3 Drawing Sheets

(51) Int. Cl.

| | |
|---|---|
| ***D06F 34/24*** | (2020.01) |
| *D06F 33/36* | (2020.01) |
| *D06F 103/16* | (2020.01) |
| *D06F 103/18* | (2020.01) |
| *D06F 105/04* | (2020.01) |
| *D06F 105/10* | (2020.01) |
| *D06F 105/58* | (2020.01) |

(52) U.S. Cl.
CPC ..... *D06F 2103/16* (2020.02); *D06F 2103/18* (2020.02); *D06F 2105/04* (2020.02); *D06F 2105/10* (2020.02); *D06F 2105/58* (2020.02)

(56) References Cited

FOREIGN PATENT DOCUMENTS

| | | | | |
|---|---|---|---|---|
| CN | 102587079 | A | 7/2012 | |
| CN | 102926170 | A | 2/2013 | |
| CN | 104233718 | A | 12/2014 | |
| CN | 106930038 | A | 7/2017 | |
| CN | 107034631 | A | 8/2017 | |
| CN | 207259796 | U | 4/2018 | |
| CN | 108930124 | A | 12/2018 | |
| CN | 109137387 | A | 1/2019 | |
| CN | 112251981 | A | 1/2021 | |
| WO | WO-2019154297 | A1 * | 8/2019 | ..... D06F 33/00 |

OTHER PUBLICATIONS

Machine translation of CN104233718A, dated Dec. 24, 2014. (Year: 2014).*
1st OA & 1st Search Report issued on Aug. 1, 2022 for CN Application No. 202010936519.6.
2nd OA issued on Mar. 17, 2023 for CN Application No. 202010936519.6.
ISR mailed Jul. 9, 2021 for PCT App No. PCT/CN2021/086658.

* cited by examiner

LAUNDRY TREATMENT DEVICE, WATER TEMPERATURE CONTROL METHOD AND APPARATUS THEREFOR, AND STORAGE MEDIUM

CROSS-REFERENCES TO RELATED APPLICATIONS

The present disclosure is a national phase application of International Application No. PCT/CN2021/086658, filed on Apr. 12, 2021, which claims priority to Chinese Patent Application No. 202010936519.6, filed on Sep. 8, 2020, the entireties of which are herein incorporated by reference.

FIELD

The present disclosure relates to the field of laundry treating equipment technologies, and more particularly, to a water temperature control method for a laundry treating device, a computer-readable storage medium, a laundry treating device, and a water temperature control apparatus for a laundry treating device.

BACKGROUND

In the related art, a water inflow temperature of a laundry treating device often calculates water inflowing time based on a temperature and a water flow rate, and then let water flow in based on the corresponding water inflowing time to obtain hot water with a temperature predetermined by a user. However, since this method is greatly influenced by factors such as an external ambient temperature or the number of loads, there is a large difference between a water temperature after the water inflowing is completed and the temperature predetermined by the user. Therefore, heating with a heating pipe for a long time is required in order to reach the temperature predetermined by user, and control through various devices such as a water level sensor, a flow meter, and a temperature sensor is also required, which leads to phenomena of high cost, resource waste, etc.

SUMMARY

The present disclosure aims to solve at least one of the problems in the related art. To this end, one object of the present disclosure is to provide a water temperature control method for a laundry treating device, may accurately control the water temperature of the laundry treating device while reducing cost of controlling the temperature.

A second object of the present disclosure is to provide a computer-readable storage medium.

A third object of the present disclosure is to provide a laundry treating device.

A fourth object of the present disclosure is to provide a water temperature control apparatus for a laundry treating device.

In order to achieve the above objects, embodiments of the present disclosure provide a water temperature control method for a laundry treating device. The laundry treating device includes a cold water inlet and a hot water inlet, and the water temperature control method includes: detecting a water temperature in the laundry treating device in response to determining that warm water is to be introduced into the laundry treating device, and controlling the laundry treating device based on the water temperature to enable inflowing of cold water through the cold water inlet and inflowing of hot water through the hot water inlet alternately; detecting a water level in the laundry treating device, and controlling the laundry treating device to stop water inflowing in response to determining that the water level in the laundry treating device reaches a first predetermined water level; and controlling the laundry treating device to perform washing for a first predetermined duration based on a predetermined washing cycle, and then controlling the laundry treating device based on the water temperature to enable inflowing of the cold water through the cold water inlet and inflowing of the hot water through the hot water inlet alternately until the water level in the laundry treating device reaches a second predetermined water level, wherein the second predetermined water level is higher than the first predetermined water level.

According to the water temperature control method for the laundry treating device of the embodiments of the present disclosure, the water temperature in the laundry treating device is detected in response to determining that the warm water is to be introduced into the laundry treating device, and the laundry treating device is controlled based on the water temperature to enable the inflowing of the cold water through the cold water inlet and the inflowing of the hot water through the hot water inlet alternately; the laundry treating device is controlled to stop water inflowing in response to determining that the water level in the laundry treating device reaches the first predetermined water level; and the laundry treating device is controlled to perform washing for the first predetermined duration based on the predetermined washing cycle, and the laundry treating device is controlled based on the water temperature to enable the inflowing of the cold water through the cold water inlet and the inflowing of the hot water through the hot water inlet alternately until the water level in the laundry treating device reaches the second predetermined water level. The second predetermined water level is higher than the first predetermined water level. Hence, the water temperature control method for the laundry treating device may accurately control the water temperature of the laundry treating device while reducing cost of controlling the temperature.

In addition, the water temperature control method for the laundry treating device described above in the present disclosure may further have the following additional features.

According to an embodiment of the present disclosure, the water temperature control method for the laundry treating device further includes: controlling the laundry treating device to enable continuous inflowing of the cold water through the cold water inlet for a second predetermined duration first or enable inflowing of the hot water through the hot water inlet and inflowing of the cold water through the cold water inlet simultaneously for the second predetermined duration first, in response to determining that the warm water is to be introduced into the laundry treating device.

According to an embodiment of the present disclosure, said controlling the laundry treating device based on the water temperature to enable inflowing of the cold water through the cold water inlet and inflowing of the hot water through the hot water inlet alternately includes: determining whether the water temperature is smaller than a difference between a target water temperature and a predetermined temperature threshold; if so, controlling the laundry treating device to enable continuous inflowing of the hot water through the hot water inlet for a third predetermined duration; and otherwise, controlling the laundry treating device to enable continuous inflowing of the cold water through the cold water inlet for a fourth predetermined duration.

According to an embodiment of the present disclosure, the water temperature control method for the laundry treating device includes, during the inflowing of the hot water through the hot water inlet in the laundry treating device: controlling the laundry treating device to be switched to and maintain inflowing of the cold water through the cold water inlet, in response to no change occurring to the water level in the laundry treating device within a fifth predetermined duration.

According to an embodiment of the present disclosure, the water temperature control method for the laundry treating device includes, during the inflowing of the hot water through the hot water inlet in the laundry treating device: controlling the laundry treating device to drain water, in response to no change occurring to the water level in the laundry treating device within a fifth predetermined duration.

According to an embodiment of the present disclosure, the water temperature control method for the laundry treating device further includes, after completing the draining: controlling the laundry treating device to enable inflowing of the cold water through the cold water inlet while performing alarm issuing and counting, and controlling the laundry treating device to stop water inflow in response to time for performing the alarm issuing and counting reaching a sixth predetermined duration.

According to an embodiment of the present disclosure, the water temperature control method for the laundry treating device further includes: controlling a heating unit of the laundry treating device to start up to perform a heating operation, in response to the water level in the laundry treating device reaching the second predetermined water level and determining that the water temperature has not reached a target water temperature.

According to an embodiment of the present disclosure, the water temperature control method for the laundry treating device further includes: controlling the laundry treating device to enable inflowing of the hot water through the hot water inlet, in response to determining that the hot water is to be introduced into the laundry treating device; controlling the laundry treating device to stop water inflow in response to the water level in the laundry treating device reaching the first predetermined water level; and controlling the laundry treating device to performing washing for the first predetermined duration based on the predetermined washing cycle, and then controlling the laundry treating device to enable inflowing of the hot water through the hot water inlet until the water level in the laundry treating device reaches the second predetermined water level.

According to an embodiment of the present disclosure, the water temperature control method for the laundry treating device further includes: controlling the laundry treating device to enable inflowing of the cold water through the cold water inlet, in response to determining that the cold water is to be introduced into the laundry treating device; controlling the laundry treating device to stop water inflowing in response to the water level in the laundry treating device reaching the first predetermined water level; and controlling the laundry treating device to performing washing for the first predetermined duration based on the predetermined washing cycle, and then controlling the laundry treating device to enable inflowing of the cold water through the cold water inlet until the water level in the laundry treating device reaches the second predetermined water level.

According to an embodiment of the present disclosure, the water temperature control method for the laundry treating device further includes: determining an inflowing water type of the laundry treating device based on a target temperature. The inflowing water type includes the warm water, the hot water, and the cold water.

The embodiments of the present disclosure provide a computer-readable storage medium, having a water temperature control program for a laundry treating device stored thereon. The water temperature control program, when executed by a processor, implements the water temperature control method for the laundry treating device according to the embodiments described above.

According to the storage medium of the embodiments of the present disclosure, the water temperature control program for the laundry treating device is stored on the storage medium and corresponds to the water temperature control method of the laundry treating device in the embodiments described above, and the water temperature control program, when executed by the processor, may accurately control the water temperature of the laundry treating device while reducing the cost of controlling the temperature.

The embodiments of the present disclosure provide a laundry treating device, including: a memory; a processor; and a water temperature control program for a laundry treating device stored on the memory and executable on the processor. The processor, when executing the water temperature control program, implements the water temperature control method for the laundry treating device described above.

According to the laundry treating device of the embodiments of the present disclosure, the processor, when executing the water temperature control program for the laundry treating device stored on the memory, may accurately control the water temperature of the laundry treating device while reducing the cost of controlling the temperature.

The embodiments of the present disclosure provide a water temperature control apparatus for a laundry treating device. The laundry treating device includes a cold water inlet and a hot water inlet, and the water temperature control apparatus includes: a water temperature detection device configured to detect a water temperature in the laundry treating device; a water level detection device configured to detect a water level in the laundry treating device; and a control device configured to: control the laundry treating device based on the water temperature to enable inflowing of cold water through the cold water inlet and inflowing of hot water through the hot water inlet alternately, in response to determining that warm water is to be introduced into the laundry treating device; control the laundry treating device to stop water inflow in response to determining that the water level in the laundry treating device reaches a first predetermined water level; and controlling the laundry treating device to perform washing for a first predetermined duration based on a predetermined washing cycle, and then control the laundry treating device to enable inflowing of the cold water through the cold water inlet and inflowing of the hot water through the hot water inlet alternately until the water level in the laundry treating device reaches a second predetermined water level, wherein the second predetermined water level is higher than the first predetermined water level.

According to the water temperature control apparatus for the laundry treating device of the embodiments of the present disclosure, the water temperature in the laundry treating device is detected by the water temperature detection device, and the water level in the laundry treating device is detected by the water level detection device. The laundry treating device is controlled by the control device based on the water temperature to enable the inflowing of cold water through the cold water inlet and the inflowing of hot water through the hot water inlet alternately, in response to determining that the warm water is to be introduced into the laundry treating device. The laundry treating device is controlled by the control device to stop water inflowing in response to determining that the water level in the laundry treating device reaches the first predetermined water level. The laundry treating device is controlled to perform washing for the first predetermined duration based on the predetermined washing cycle, and then the laundry treating device is controlled to enable inflowing of the cold water through the cold water inlet and inflowing of the hot water through the hot water inlet alternately until the water level in the laundry treating device reaches the second predetermined water level. The second predetermined water level is higher than the first predetermined water level. Hence, the control apparatus may accurately control the water temperature of the laundry treating device while reducing the cost of controlling the temperature.

Additional embodiments of present disclosure will be provided at least in part in the following description, or will become apparent in part from the following description, or can be learned from the practice of the embodiments of the present disclosure.

BRIEF DESCRIPTION OF THE DRAWINGS

The accompanying drawings are used to provide a further understanding of the present disclosure, and constitute a part of the specification, together with the following detailed description, to explain the present disclosure, but not to limit the present disclosure. In the accompanying drawings.

DETAILED DESCRIPTION OF THE DISCLOSURE

Figure 1:
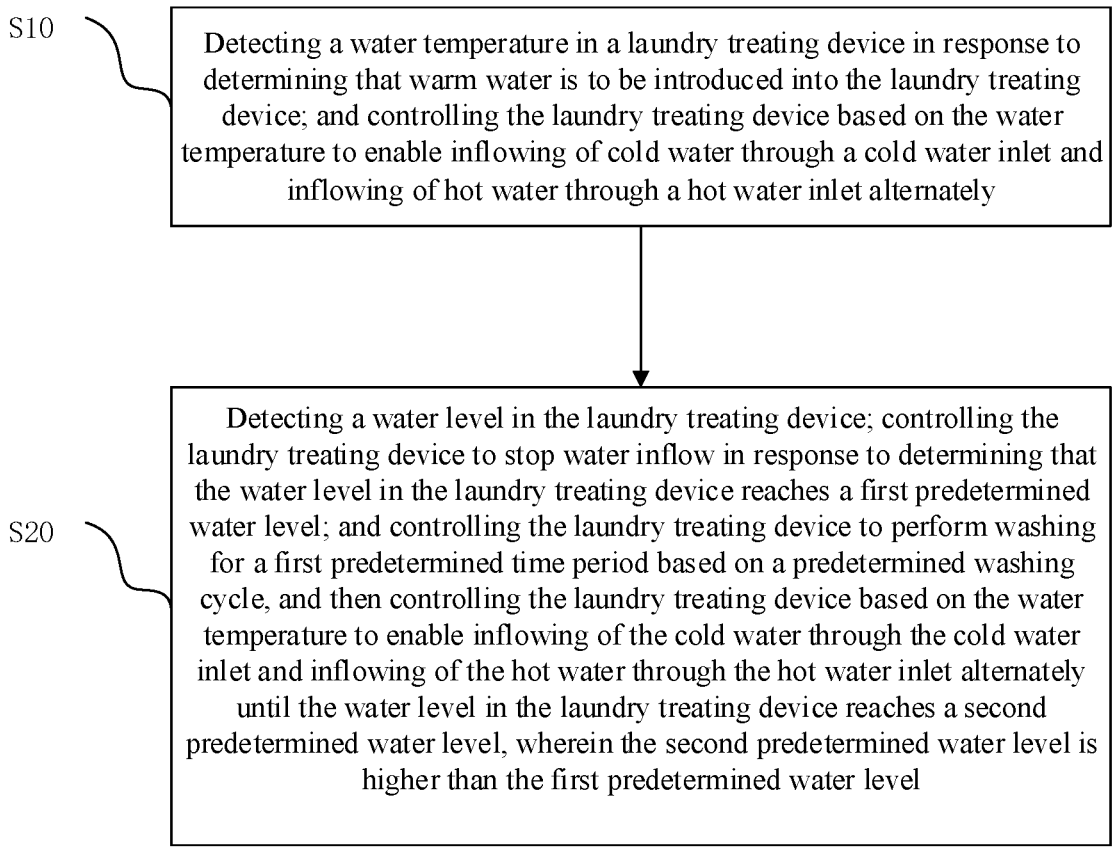
FIG. 1 is a flowchart of a water temperature control method for a laundry treating device according to an embodiment of the present disclosure.

The embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are illustrative only, and are intended to explain rather than limit the present disclosure.

A laundry treating device, a water temperature control method and apparatus thereof, and a storage medium of the embodiments of the present disclosure are described below with reference to the accompanying drawings.

FIG. 1 is a flowchart of a water temperature control method for a laundry treating device according to an embodiment of the present disclosure.

It should be noted that the laundry treating device in this embodiment may be a double water inlet washing machine. A cold water inlet and a hot water inlet are provided in the laundry treating device. The cold water inlet is used to introduce cold water into the laundry treating device, and the hot water inlet is used to introduce hot water into the laundry treating device. It should be understood that the cold water inlet may be directly connected to a faucet for the cold outflowing water in a household, and the hot water inlet may be directly connected to a faucet for the hot outflowing water in the household, or a heating unit may be provided to heat water ready to flow out of the hot water inlet.

As illustrated in FIG. 1, the water temperature control method of the laundry treating device includes actions at the following blocks.

At block S10, a water temperature in the laundry treating device is detected in response to determining that warm water is to be introduced into the laundry treating device, and the laundry treating device is controlled based on the water temperature to enable inflowing of cold water through the cold water inlet and inflowing of hot water through the hot water inlet alternately.

In some embodiments, when different laundries are washed by the laundry treating device, different water temperatures may be selected for washing to protect the laundries and also achieve a better washing effect. A target temperature of the water inflowing may be selected before the laundry treating device is controlled to operate. In some examples of the present disclosure, an inflowing water type of the laundry treating device may be determined based on the target temperature. The inflowing water type includes warm water, hot water, and cold water. It should be understood that, when it is determined that the inflowing water type of the laundry treating device is the hot water, only the hot water inlet is controlled to operate, and the hot water is introduced into the laundry treating device; when it is determined that the inflowing water type of the laundry treating device is the cold water, only the cold water inlet is controlled to operate, and the cold water is introduced into the laundry treating device; and when it is determined that the inflowing water type of the laundry treating device is the warm water, the water temperature in the laundry treating device is detected, and the laundry treating device is controlled based on the water temperature to enable inflowing of the cold water through the cold water inlet and inflowing of the hot water through the hot water inlet alternately.

It should be noted that a touch user interaction interface may be further provided on the laundry treating device, and a user may set a temperature via the interaction interface to generate a target water temperature to be reached by controlling the laundry treating device.

In some examples of the present disclosure, the laundry treating device is controlled to enable continuous inflowing of the cold water through the cold water inlet for a second predetermined duration first or enable inflowing of the hot water through the hot water inlet and inflowing of the cold water through the cold water inlet simultaneously for the second predetermined duration first, in response to determining that the warm water is to be introduced into the laundry treating device.

In some embodiments, in response to determining that the inflowing water type of the laundry treating device is the warm water, the cold water inlet may be controlled to enable continuous inflowing of the cold water for the second predetermined duration first or enable inflowing of water through the hot water inlet and the cold water inlet simultaneously for the second predetermined duration first, hence avoiding introducing hot water first in a subsequent process of alternate water inflowing, thereby preventing the laundry only suitable for washing by the warm water from being scalded by the hot water. Optionally, the second predetermined duration may be selected based on a number and/or weight of the laundry to be treated, and it should be understood that the second predetermined duration is directly proportional to the number and/or weight of the laundry to be treated. In this embodiment, the second predetermined duration is 10 seconds.

It should be understood that, in some embodiments of the present disclosure, 5 inflowing water types may be provided, which are cold inflowing water, inflowing water in an energy-saving mode, warm inflowing water, hot inflowing water, and hot inflowing water +. The symbol "+" represents a higher degree. In this embodiment, the cold inflowing water and hot inflowing water + correspond to a case where only the cold water inlet is opened and a case where only the hot water inlet is opened, respectively, and other inflowing water types are in a mode that enables the inflowing of water through the cold water inlet and the hot water inlet alternately. Optionally, a water temperature of the inflowing water in the energy-saving mode is 30° C., a temperature of the warm water is 38° C., a temperature of the hot water is 54° C., a temperature of the hot water + is 71° C., and an error is controlled between −5° C. and +5° C. It should be understood that a temperature of 30° C. or lower is a water temperature of cold water.

At block S20, a water level in the laundry treating device is detected; the laundry treating device is controlled to stop water inflowing in response to determining that the water level in the laundry treating device reaches a first predetermined water level; and the laundry treating device is controlled to perform washing for a first predetermined duration based on a predetermined washing cycle, and then the laundry treating device is controlled based on the water temperature to enable inflowing of the cold water through the cold water inlet and inflowing of the hot water through the hot water inlet alternately again until the water level in the laundry treating device reaches a second predetermined water level. The second predetermined water level is higher than the first predetermined water level.

In some embodiments, the water level in the laundry treating device is detected after the inflowing of water for a period of time. It should be understood that, in this embodiment, the water level in the laundry treating device may be a water level in an inner tub of the laundry treating device. After the water level in the laundry treating device reaches the first predetermined water level, the laundry treating device is controlled to stop the water inflowing, and the laundry treating device is controlled to performing washing for the first predetermined duration based on the predetermined washing cycle. Optionally, the first predetermined water level is a water level at which the inner tub of the laundry treating device is submerged by one centimeter. The first predetermined duration and the first predetermined water level may have an error of ±10%.

After the laundry treating device is controlled to perform washing for the first predetermined duration based on the predetermined washing cycle, the laundry treating device is controlled based on the water temperature to enable inflowing of the cold water through the cold water inlet and inflowing of the hot water through the hot water inlet alternately until the water level in the laundry treating device reaches the second predetermined water level. The second predetermined water level may be a water level in the inner tub of the laundry treating device required for this time of laundry washing. It should be understood that the second predetermined water level is high than the first predetermined water level.

It should be noted that, in this embodiment, the inner tub of the laundry treating device rotates for 80 seconds in each predetermined washing cycle. The laundry treating device pauses for 5 seconds after operating for 15 seconds every time, and the inner tub of the laundry treating device rotates 45 revolutions within every 15 seconds.

Figure 2:
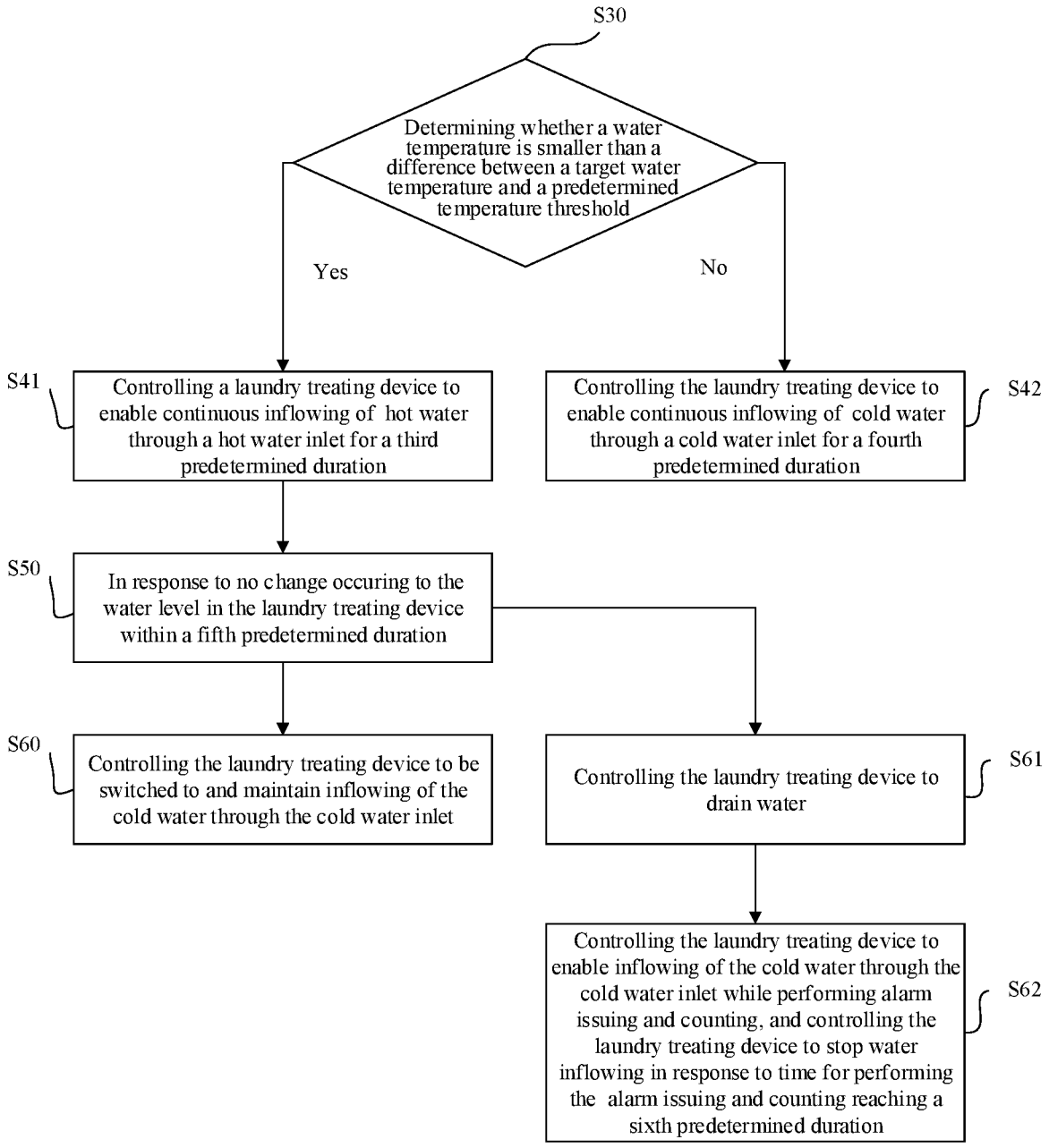
FIG. 2 is a flowchart of a water temperature control method for a laundry treating device according to a specific embodiment of the present disclosure.

In this embodiment, as illustrated in FIG. 2, the action of controlling the laundry treating device based on the water temperature to enable inflowing of the cold water through the cold water inlet and inflowing of the hot water through the hot water inlet alternately includes: S30, determining whether the water temperature is smaller than a difference between a target water temperature and a predetermined temperature threshold; S41, if so, controlling the laundry treating device to enable continuous inflowing of the hot water through the hot water inlet for a third predetermined duration; and S42, otherwise, controlling the laundry treating device to enable continuous inflowing of the cold water through the cold water inlet for a fourth predetermined duration.

In some embodiments, after the laundry treating device has performed washing for the first predetermined duration based on the predetermined washing cycle, the water temperature in the laundry treating device may be detected, and the detected water temperature is compared with the target water temperature. When the water temperature is smaller than the difference between the target water temperature and the predetermined temperature threshold, indicating that a current water temperature in the laundry treating device is significantly lower than the target temperature, the laundry treating device may be controlled to enable the continuous inflowing of the hot water through the hot water inlet for the third predetermined duration. When the water temperature is greater than or equal to the difference between the target water temperature and the predetermined temperature threshold, indicating that a current water temperature in the laundry treating device is close to or significantly higher than the target temperature, the laundry treating device may be controlled to enable the continuous inflowing of the cold water through the cold water inlet for the fourth predetermined duration. Optionally, the third predetermined duration and the fourth predetermined duration may be selected based on the predetermined temperature threshold. For example, the third predetermined duration and the fourth predetermined duration increase as the predetermined temperature threshold increases; and the third predetermined duration and the fourth predetermined duration decrease as the predetermined temperature threshold decreases. In this embodiment, the predetermined temperature threshold is 5° C., the third predetermined duration is set as 10 seconds, and the fourth predetermined duration is also set as 10 seconds.

In this embodiment, as illustrated in FIG. 2, the water level in the laundry treating device is further determined in the process of the inflowing of the hot water through the hot water inlet in the laundry treating device, which includes actions at the following blocks: S50, in response to no change occurring to the water level in the laundry treating device within a fifth predetermined duration; and S60, controlling the laundry treating device to be switched to and maintain inflowing of the cold water through the cold water inlet.

In some embodiments, in the process of controlling the laundry treating device to enable the inflowing of the hot water through the hot water inlet, the laundry treating device is controlled to be switched to and maintain the inflowing of the cold water through the cold water inlet, in response to no change occurring to the water level in the laundry treating device within the fifth predetermined duration. It should be understood that when the water level in the laundry treating device has not changed due to the inflowing of hot water through the hot water inlet within the fifth predetermined duration, it indicates that an exception may occur to the laundry device, e.g., the hot water inlet is not opened. In this case, the cold water inlet is controlled to introduce the cold water to give priority to completing a function of washing the laundry, and after the washing is completed, an attempt is made to open the hot water inlet to detect whether the hot water inlet malfunctions.

In some examples of the present disclosure, during the inflowing of the hot water through the hot water inlet in the laundry treating device, as illustrated in FIG. 2, the action at block S61 is performed in response to no change occurring to the water level in the laundry treating device within the fifth predetermined duration. At block S61, the laundry treating device is controlled to drain water. In this embodiment, after the draining is completed, an action at block S62 is performed. At block S62, the laundry treating device is controlled to enable inflowing of the cold water through the cold water inlet while performing alarm issuing and counting, and controlling the laundry treating device to stop water inflowing in response to time for performing the alarm issuing and counting reaching a sixth predetermined duration.

In some embodiments, if the water level in the laundry treating device does not change after the fifth predetermined duration, it could be understood that the laundry treating device may have a water level detection fault or a water inlet fault. In order to avoid damage to the laundry treating device caused by problems such as washing water overflowing resulted from the faults of the laundry treating device, the laundry treating device may be controlled to issue alarms to ensure safety of the laundry treating device. In some embodiments, after the laundry treating device completes the draining, the cold water was introduced through the cold water inlet and alarm issuing and counting are performed; and the laundry treating device is controlled to stop operating in response to the time for performing alarm issuing and counting reaching the sixth predetermined duration. The sixth predetermined duration may be set by the user. For example, the sixth predetermined duration is 3 minutes. In addition, it should be understood that the fifth predetermined duration may also be set by the user, and the fifth predetermined duration is longer than the third predetermined duration.

In some examples of the present disclosure, a heating unit of the laundry treating device is controlled to start up for heating, in response to determining that the water temperature has not reached the target water temperature when the water level in the laundry treating device reaches the second predetermined water level.

In some embodiments, the heating unit of the laundry treating device is controlled to start up to perform an auxiliary heating operation in response to the water temperature in the laundry treating device not reaching the target water temperature after the water inflowing operation of the laundry treating device is completed. It can be understood that, in the above embodiments with alternate inflowing of cold water and hot water to the inner tub of the laundry treating device, even if the water temperature of the inner tub of the laundry treating device has not reached the target water temperature when the water level reaches the second predetermined water level, the water temperature will not differ too much from the target water temperature, and thus it is unnecessary for the heating unit to consume a large amount of energy for heating.

In some examples of the present disclosure, the laundry treating device is controlled to enable the inflowing of the hot water through the hot water inlet, in response to determining that the hot water is to be introduced into the laundry treating device; the laundry treating device is controlled to stop water inflowing in response to the water level in the laundry treating device reaching the first predetermined water level; and the laundry treating device is controlled to perform washing for the first predetermined duration based on the predetermined washing cycle, and the laundry treating device is controlled to enable inflowing of the hot water through the hot water inlet until the water level in the laundry treating device reaches the second predetermined water level.

In some examples of the present disclosure, the laundry treating device is controlled to enable inflowing of the cold water through the cold water inlet, in response to determining that the cold water is to be introduced into the laundry treating device; the laundry treating device is controlled to stop water inflowing in response to the water level in the laundry treating device reaching the first predetermined water level; and the laundry treating device is controlled to perform washing for the first predetermined duration according to the predetermined washing cycle, and then the laundry treating device is controlled to enable inflowing of the cold water through the cold water inlet until the water level in the laundry treating device reaches the second predetermined water level.

In some embodiments, the hot water inlet or the cold water inlet is controlled to perform a water inflowing operation independently, in response to determining that the hot water or cold water is to be introduced into the laundry treating device; after the first predetermined water level is reached by the water flowing, the water inflowing is stopped, and the washing is performed for the first predetermined duration based on the predetermined washing cycle; and then, the hot water inlet or the cold water inlet is controlled to enable the inflowing of water independently until the water level in the laundry treating device reaches the second predetermined water level, to complete the water inflowing operation.

It should be noted that, after the water level in the laundry treating device reaches the second predetermined water level, the laundry treating device stops the water inflowing and starts a main washing procedure of the laundry.

To sum up, the water temperature control method for the laundry treating device according to the embodiments of the present disclosure may accurately control the water temperature of the laundry treating device while reducing cost of controlling the temperature.

Further, the present disclosure provides a computer-readable storage medium having a water temperature control program for the laundry treating device stored thereon. The water temperature control program, when executed by a processor, implements the water temperature control method for the laundry treating device according to the embodiments described above.

In the embodiments of the present disclosure, the water temperature control program for the laundry treating device is stored on the computer-readable storage medium and corresponds to the water temperature control method for the laundry treating device, and the water temperature control program, when executed by the processor, may accurately control the water temperature of the laundry treating device while reducing cost of controlling the temperature.

Further, the present disclosure provides a laundry treating device. The device includes: a memory; a processor; and a water temperature control program for a laundry treating device stored on the memory and executable on the processor. The processor, when executing the water temperature control program, implements the water temperature control method for the laundry treating device according to the embodiments described above.

In the embodiments of the present disclosure, the laundry treating device includes the memory and the processor, and the water temperature control program for the laundry treating device stored on the memory and corresponding to the water temperature control method of the laundry treating device in the above embodiments, when executed by the processor, may accurately control the water temperature of the laundry treating device while reducing cost of controlling the temperature.

Figure 3:
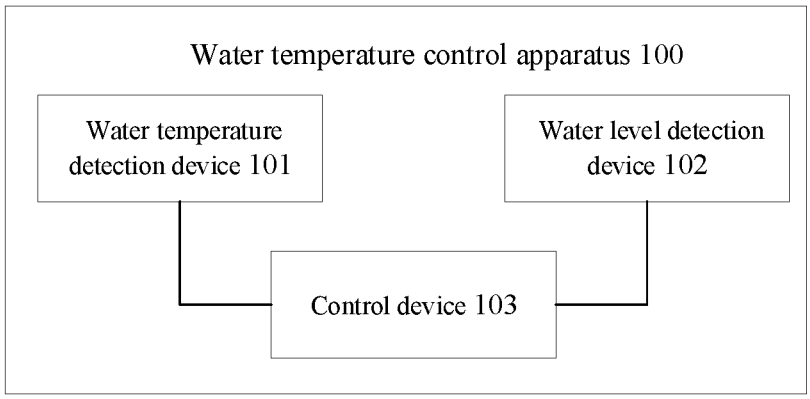
FIG. 3 is a structural block diagram of a water temperature control apparatus of a laundry treating device according to embodiments of the present disclosure.

FIG. 3 is a structural block diagram of a water temperature control apparatus for a laundry treating device according to embodiments of the present disclosure.

Further, the present disclosure provides a water temperature control device 100 for the laundry treating device. The laundry treating device includes a cold water inlet and a hot water inlet, as illustrated in FIG. 3, the water temperature control apparatus 100 includes a water temperature detection device 101, a water level detection device 102, and a control device 103.

The water temperature detection device 101 is configured to detect the water temperature in the laundry treating device. The water level detection device 102 is configured to detect a water level in the laundry treating device. The control device 103 is configured to: control the laundry treating device based on the water temperature to enable inflowing of cold water through the cold water inlet and inflowing of hot water through the hot water inlet alternately, in response to determining that warm water is to be introduced into the laundry treating device; control the laundry treating device to stop water inflowing in response to determining that the water level in the laundry treating device reaches a first predetermined water level; and controlling the laundry treating device to perform washing for a first predetermined duration based on a predetermined washing cycle, and then control the laundry treating device to enable inflowing of the cold water through the cold water inlet and inflowing of the hot water through the hot water inlet alternately until the water level in the laundry treating device reaches a second predetermined water level. The second predetermined water level is higher than the first predetermined water level.

It should be noted that the laundry treating device in this embodiment may be a double water inlet washing machine. The cold water inlet and the hot water inlet are provided in the laundry treating device. The cold water inlet is used to introduce the cold water into the laundry treating device, and the hot water inlet is used to introduce hot water into the laundry treating device. It can be understood that the cold water inlet may be directly connected to a faucet for the cold outflowing water in the household, and the hot water inlet may be directly connected to a faucet for the hot outflowing water in the household, or a heating unit may be provided to heat water ready to flow out of the hot water inlet.

In some embodiments, referring to FIG. 3, when different laundries are washed by the laundry treating device, different water temperatures may be selected for washing to protect the laundries and also achieve a better washing effect. Before controlling the laundry treating device to operate, the control device 103 may select the target temperature of the water inflowing. In some examples of the present disclosure, an inflowing water type of the laundry treating device may be determined based on the target temperature. The inflowing water types includes the warm water, the hot water, and the cold water. It should be understood that, when it is determined that the inflowing water type of the laundry treating device is the hot water, only the hot water inlet is controlled to operate, and the hot water is introduced into the laundry treating device; when it is determined that the inflowing water type of the laundry treating device is the cold water, only the cold water inlet is controlled to operate, and the cold water is introduced into the laundry treating device; and when it is determined that the inflowing water type of the laundry treating device is the warm water, the water temperature in the laundry treating device is detected, and the laundry treating device is controlled based on the water temperature to enable the inflowing of the cold water through the cold water inlet and the inflowing of the hot water through the hot water inlet alternately.

It should be noted that a touch user interaction interface may be provided on the laundry treating device, and the user may set the temperature via the interaction interface to generate the target water temperature to be reached by controlling the laundry treating device. Optionally, the water temperature detection device 101 in this embodiment may be a Negative Temperature Coefficient (NTC) thermistor.

It should be understood that, in some embodiments of the present disclosure, 5 inflowing water types may be provided, which are the cold inflowing water, inflowing water in an energy-saving mode, warm inflowing water, hot inflowing water, and hot inflowing water +. The symbol "+" represents a higher degree. In this embodiment, the cold inflowing water and hot inflowing water + correspond to a case where only the cold water inlet is opened and a case where only the hot water inlet is opened, respectively, and other inflowing water types are in a mode that enables the inflowing of water through the cold water inlet and the hot water inlet alternately. Optionally, the water temperature of the inflowing water in the energy-saving mode is 30° C., the temperature of the warm water is 38° C., the temperature of the hot water is 54° C., the temperature of the hot water + is 71° C., and the error is controlled between −5° C. and +5° C. It should be understood that the temperature of 30° C. or lower is the water temperature of cold water.

In some embodiments, the water level in the laundry treating device may be detected by the water level device 102 after the inflowing of water for a period of time. It should be understood that, in this embodiment, the water level in the laundry treating device may be a water level in an inner tub of the laundry treating device. After the water level in the laundry treating device reaches the first predetermined water level, the laundry treating device is controlled by the control device 103 to stop the water inflowing, and the laundry treating device is controlled to performing washing for the first predetermined duration based on the predetermined washing cycle. Optionally, the first predetermined water level is a water level at which the inner tub of the laundry treating device is submerged by one centimeter. The first predetermined duration may be time required for the inflowing of the cold water through the cold water inlet into the inner tub of the laundry treating device at a normal flow rate to allow the water level in the inner tub of the laundry treating device to be one centimeter. The first predetermined duration and the first predetermined water level may have an error of ±10%.

After the laundry treating device is controlled by the control device 103 to perform washing for the first predetermined duration based on the predetermined washing cycle, the laundry treating device is controlled based on the water temperature to enable the inflowing of the cold water through the cold water inlet and the inflowing of the hot water through the hot water inlet alternately again until the water level in the laundry treating device reaches the second predetermined water level. The second predetermined water level may be a water level in the inner tub of the laundry treating device required for this time of laundry washing. It should be understood that the second predetermined water level is high than the first predetermined water level.

It should be noted that, in this embodiment, the inner tub of the laundry treating device rotates for 80 seconds in each predetermined washing cycle. The laundry treating device pauses for 5 seconds after operating for 15 seconds every time, and the inner tub of the laundry treating device rotates 45 revolutions within every 15 seconds.

It should be noted that the specific implementations of the water temperature control method for the laundry treating device according to the embodiments of the present disclosure described above may be referred to for other specific implementation manners of the water temperature control apparatus for the laundry treating device according to the embodiments of the present disclosure.

It should be noted that the logics and/or steps represented in the flowchart or described otherwise herein can be, for example, considered as a list of ordered executable instructions for implementing logic functions, and can be embodied in any computer-readable medium to be used by or used in combination with an instruction execution system, apparatus, or device (such as a computer-based system, a system including a processor, or any other system that can retrieve and execute instructions from an instruction execution system, apparatus, or device). For the present disclosure, a "computer-readable medium" can be any apparatus that can contain, store, communicate, propagate, or transmit a program to be used by or used in combination with an instruction execution system, apparatus, or device. More specific examples of computer-readable mediums include, as a non-exhaustive list: an electrical connector (electronic device) with one or more wirings, a portable computer disk case (magnetic devices), a Random Access Memory (RAM), a Read Only Memory (ROM), an Erasable Programmable Read Only Memory (EPROM or flash memory), a fiber optic device, and a portable Compact Disk Read Only memory (CDROM). In addition, the computer-readable medium may even be paper or other suitable medium on which the program can be printed, as the program can be obtained electronically, e.g., by optically scanning the paper or the other medium, and then editing, interpreting, or otherwise processing the scanning result when necessary, and then stored in a computer memory.

It should be understood that each part of the present disclosure can be implemented in hardware, software, firmware, or any combination thereof. In the above embodiments, a number of steps or methods can be implemented using software or firmware stored in a memory and executed by a suitable instruction execution system. For example, when implemented in hardware, as in another embodiment, it can be implemented by any one or combination of the following technologies known in the art: a discrete logic circuit having logic gate circuits for implementing logic functions on data signals, an application-specific integrated circuit with suitable combined logic gate circuits, a Programmable Gate Array (PGA), a Field Programmable Gate Array (FPGA), etc.

In the disclosure, the description with reference to the terms "an embodiment", "some embodiments", "an example", "a specific example", or "some examples", etc., means that specific features, structures, materials, or characteristics described in conjunction with the embodiment or example are included in at least one embodiment or example of the present disclosure. In this specification, any schematic representation of the above terms does not necessarily refer to the same embodiment or example. Moreover, the specific features, structures, materials, or characteristics described can be combined in any one or more embodiments or examples in an appropriate manner.

In the description of the present disclosure, it is to be understood that an orientation or position relationship indicated by terms such as "center", "longitudinal", "lateral", "length", "width", "thickness", "over", "below", "front", "back", "left", "right", "vertical", "horizontal", "top", "bottom", "inner", "outer", "clockwise", "counterclockwise", "axial", "radial", "circumferential", etc., is based on the orientation or position relationship shown in the accompanying drawings, and is only for the convenience of describing the present disclosure and simplifying the description, rather than indicating or implying that the indicated device or element must have a specific orientation, or be constructed and operated in a specific orientation, and therefore cannot be understood as a limitation on the present disclosure.

In addition, the terms "first" and "second" are only used for descriptive purposes, and cannot be understood as indicating or implying relative importance or implicitly indicating the number of indicated features. Therefore, the features defined with "first" and "second" may explicitly or implicitly include at least one of the features. In the description of the present disclosure, "plurality" means at least two, e.g., two, three, etc., unless otherwise specifically defined.

In the present disclosure, unless otherwise clearly specified and limited, terms such as "install", "connect", "connected", "fix" and the like should be understood in a broad sense. For example, it may be a fixed connection or a detachable connection or connection as one piece; mechanical connection or electrical connection; direct connection or indirect connection through an intermediate; internal communication of two components or the interaction relationship between two components. The specific meaning of the above-mentioned terms in the present disclosure can be understood according to specific circumstances.

In the present disclosure, unless expressly stipulated and defined otherwise, the first feature being "on" or "under" the second feature may mean that the first feature is in direct contact with the second feature, or the first and second features are in indirect contact through an intermediate. Moreover, the first feature being "above" the second feature may mean that the first feature is directly above or obliquely above the second feature, or simply mean that the level of the first feature is higher than that of the second feature. The first feature being "below" the second feature may mean that the first feature is directly below or obliquely below the second feature, or simply mean that the level of the first feature is lower than that of the second feature.

Although the embodiments of the present disclosure have been shown and described above, it can be understood that the above-mentioned embodiments are exemplary and should not be construed as limiting the present disclosure.

What is claimed is:

1. A water temperature control method for a laundry treating device, the laundry treating device comprising a cold water inlet and a hot water inlet, the water temperature control method comprising:

detecting a water temperature in the laundry treating device in response to an instruction that warm water is to be introduced into the laundry treating device, and controlling the laundry treating device based on the water temperature to enable inflowing of cold water through the cold water inlet and inflowing of hot water through the hot water inlet alternately;

detecting a water level in the laundry treating device, and controlling the laundry treating device to stop water inflowing in response to a signal that the water level in the laundry treating device reaches a first predetermined water level; and controlling the laundry treating device to perform washing for a first predetermined duration based on a predetermined washing cycle;

detecting the water temperature in the laundry treating device, and then controlling the laundry treating device based on the water temperature to enable inflowing of the cold water through the cold water inlet and inflowing of the hot water through the hot water inlet alternately until the water level in the laundry treating device reaches a second predetermined water level;

wherein the second predetermined water level is higher than the first predetermined water level;

wherein said controlling the laundry treating device based on the water temperature to enable inflowing of the cold water through the cold water inlet and inflowing of the hot water through the hot water inlet alternately comprises:

wherein during the enabling inflowing of the hot water through the hot water inlet through the hot water inlet in the laundry treating device, controlling the laundry treating device to be switched to inflowing of the cold water through the cold water inlet and then completing a washing cycle, in response to no change occurring to the water level in the laundry treating device within a predetermined duration.

2. The water temperature control method for the laundry treating device according to claim 1, further comprising:

controlling the laundry treating device to first enable continuous inflowing of the cold water through the cold water inlet for a second predetermined duration or first enable inflowing of the hot water through the hot water inlet and inflowing of the cold water through the cold water inlet simultaneously for the second predetermined duration, in response to determining that the warm water is to be introduced into the laundry treating device.

3. The water temperature control method for the laundry treating device according to claim 1, wherein said controlling the laundry treating device based on the water temperature to enable inflowing of the cold water through the cold water inlet and inflowing of the hot water through the hot water inlet alternately comprises:

determining whether the water temperature is smaller than a difference between a target water temperature and a predetermined temperature threshold;

if so, controlling the laundry treating device to enable continuous inflowing of the hot water through the hot water inlet for a third predetermined duration; and otherwise, controlling the laundry treating device to enable continuous inflowing of the cold water through the cold water inlet for a fourth predetermined duration.

4. The water temperature control method for the laundry treating device according to claim 3, comprising, during the inflowing of the hot water through the hot water inlet in the laundry treating device:

controlling the laundry treating device to drain water, in response to no change occurring to the water level in the laundry treating device within a fifth predetermined duration.

5. The water temperature control method for the laundry treating device according to claim 4, further comprising, after completing draining:

controlling the laundry treating device to enable inflowing of the cold water through the cold water inlet while performing alarm issuing and counting, and controlling the laundry treating device to stop water inflowing in response to time for performing the alarm issuing and counting reaching a sixth predetermined duration.

6. The water temperature control method for the laundry treating device according to claim 1, further comprising:

controlling a heating unit of the laundry treating device to start up to perform a heating operation, in response to the water level in the laundry treating device reaching the second predetermined water level and determining that the water temperature has not reached a target water temperature.

7. The water temperature control method for the laundry treating device according to claim 1, further comprising:

controlling the laundry treating device to enable inflowing of the hot water through the hot water inlet, in response to determining that the hot water is to be introduced into the laundry treating device;

controlling the laundry treating device to stop water inflowing in response to the water level in the laundry treating device reaching the first predetermined water level; and controlling the laundry treating device to performing washing for the first predetermined duration based on the predetermined washing cycle, and then controlling the laundry treating device to enable inflowing of the hot water through the hot water inlet until the water level in the laundry treating device reaches the second predetermined water level.

8. The water temperature control method for the laundry treating device according to claim 1, further comprising:

controlling the laundry treating device to enable inflowing of the cold water through the cold water inlet, in response to determining that the cold water is to be introduced into the laundry treating device;

controlling the laundry treating device to stop water inflowing in response to the water level in the laundry treating device reaching the first predetermined water level; and controlling the laundry treating device to performing washing for the first predetermined duration based on the predetermined washing cycle, and then controlling the laundry treating device to enable inflowing of the cold water through the cold water inlet until the water level in the laundry treating device reaches the second predetermined water level.

9. The water temperature control method for the laundry treating device according to claim 1, comprising:

determining an inflowing water type of the laundry treating device based on a target temperature, wherein the inflowing water type comprises the warm water, the hot water, and the cold water.

10. A computer-readable storage medium, having a water temperature control program for a laundry treating device stored thereon, wherein the water temperature control program, when executed by a processor, implements the water temperature control method for the laundry treating device according to claim 1.

11. A laundry treating device, comprising:

a memory;

a processor; and a water temperature control program for a laundry treating device stored on the memory and executable on the processor;

wherein the processor, when executing the water temperature control program, implements the water temperature control method for the laundry treating device which causes the processor to:

detect a water temperature in the laundry treating device in response to an instruction that warm water is to be introduced into the laundry treating device, and control the laundry treating device based on the water temperature to enable inflowing of cold water through the cold water inlet and inflowing of hot water through the hot water inlet alternately;

detect a water level in the laundry treating device, and control the laundry treating device to stop water inflowing in response to a signal that the water level in the laundry treating device reaches a first predetermined water level; and control the laundry treating device to perform washing for a first predetermined duration based on a predetermined washing cycle;

detect the water temperature in the laundry treating device, and then control the laundry treating device based on the water temperature to enable inflowing of the cold water through the cold water inlet and inflowing of the hot water through the hot water inlet alternately until the water level in the laundry treating device reaches a second predetermined water level, wherein the second predetermined water level is higher than the first predetermined water level;

wherein said control the laundry treating device based on the water temperature to enable inflowing of the cold water through the cold water inlet and inflowing of the hot water through the hot water inlet alternately comprises:

wherein during the enabling inflowing of the hot water through the hot water inlet in the laundry treating device, control the laundry treating device to be switched to inflowing of the cold water through the cold water inlet and then complete a washing cycle, in response to no change occurring to the water level in the laundry treating device within a predetermined duration.

12. A water temperature control apparatus for a laundry treating device, the laundry treating device comprising a cold water inlet and a hot water inlet, and the water temperature control apparatus comprising:

a water temperature detection device configured to detect a water temperature in the laundry treating device;

a water level detection device configured to detect a water level in the laundry treating device; and a control device configured to:

control the laundry treating device based on the water temperature to enable inflowing of cold water through the cold water inlet and inflowing of hot water through the hot water inlet alternately, in response to an instruction that warm water is to be introduced into the laundry treating device; and control the laundry treating device to stop water inflowing in response to a signal that the water level in the laundry treating device reaches a first predetermined water level; and control the laundry treating device to perform washing for a first predetermined duration based on a predetermined washing cycle;

detect the water temperature in the laundry treating device, and then control the laundry treating device to enable inflowing of the cold water through the cold water inlet and inflowing of the hot water through the hot water inlet alternately until the water level in the laundry treating device reaches a second predetermined water level;

wherein the second predetermined water level is higher than the first predetermined water level;

wherein said controlling the laundry treating device based on the water temperature to enable inflowing of the cold water through the cold water inlet and inflowing of the hot water through the hot water inlet alternately comprises:

wherein during the enabling inflowing of the hot water through the hot water inlet in the laundry treating device, controlling the laundry treating device to be switched to inflowing of the cold water through the cold water inlet and then completing a washing cycle, in response to no change occurring to the water level in the laundry treating device within a predetermined duration.

13. The water temperature control apparatus for the laundry treating device according to claim 12, wherein the control device is further configured to:

controlling the laundry treating device to first enable continuous inflowing of the cold water through the cold water inlet for a second predetermined duration or first enable inflowing of the hot water through the hot water inlet and inflowing of the cold water through the cold water inlet simultaneously for the second predetermined duration, in response to determining that the warm water is to be introduced into the laundry treating device.

14. The water temperature control apparatus for the laundry treating device according to claim 12, wherein said controlling the laundry treating device based on the water temperature to enable inflowing of the cold water through the cold water inlet and inflowing of the hot water through the hot water inlet alternately comprises:

determining whether the water temperature is smaller than a difference between a target water temperature and a predetermined temperature threshold;

if so, controlling the laundry treating device to enable continuous inflowing of the hot water through the hot water inlet for a third predetermined duration; and otherwise, controlling the laundry treating device to enable continuous inflowing of the cold water through the cold water inlet for a fourth predetermined duration.

15. The water temperature control apparatus for the laundry treating device according to claim 14, comprising, during the inflowing of the hot water through the hot water inlet in the laundry treating device:

controlling the laundry treating device to drain water, in response to no change occurring to the water level in the laundry treating device within a fifth predetermined duration.

16. The water temperature control apparatus for the laundry treating device according to claim 15, further comprising, after completing draining:

controlling the laundry treating device to enable inflowing of the cold water through the cold water inlet while performing alarm issuing and counting, and controlling the laundry treating device to stop water inflowing in response to time for performing the alarm issuing and counting reaching a sixth predetermined duration.

17. The water temperature control apparatus for the laundry treating device according to claim 12, wherein the control device is further configured to:

control a heating unit of the laundry treating device to start up to perform a heating operation, in response to the water level in the laundry treating device reaching the second predetermined water level and determining that the water temperature has not reached a target water temperature.

* * * * *